US006019682A

United States Patent [19]

Arabo

[11] Patent Number: 6,019,682

[45] **Date of Patent: *Feb. 1, 2000**

[54] VEHICLE FOR AMUSEMENT GAME

[76] Inventor: Emile Arabo, 21845 Tuller Ct., Southfield, Mich. 48076

[ * ] Notice: This patent is subject to a terminal disclaimer.

[21] Appl. No.: 08/756,726

[22] Filed: Nov. 26, 1996

Related U.S. Application Data

[63] Continuation-in-part of application No. 08/206,117, Mar. 4, 1994, Pat. No. 5,577,736.

[51] Int. Cl.[7] ..... A63B 67/00

[52] U.S. Cl. ..... 463/52; 180/65.1; 463/51; 463/53

[58] Field of Search ..... 273/442; 180/7.1, 180/54.1, 65.1; 463/50, 51, 52, 53, 54

[56] References Cited

U.S. PATENT DOCUMENTS

| | | | |
|---|---|---|---|
| 3,865,528 | 2/1975 | Roess | 425/145 |
| 4,237,990 | 12/1980 | La | 180/7.1 |
| 4,561,849 | 12/1985 | Eichweber | 463/52 |
| 4,825,971 | 5/1989 | Bernstein | 180/65.1 |
| 4,898,382 | 2/1990 | Lamanna | 273/442 |
| 4,938,483 | 7/1990 | Yavetz | 463/5 |
| 4,991,835 | 2/1991 | Lamanna | 273/442 |
| 5,040,429 | 8/1991 | Del Castillo | 74/424 |
| 5,100,155 | 3/1992 | Lamanna | 273/442 |
| 5,141,173 | 8/1992 | Lay | 244/2 |
| 5,251,910 | 10/1993 | Lamanna | 273/442 |
| 5,577,736 | 11/1996 | Arabo | 273/442 |

*Primary Examiner*—Jessica Harrison
*Assistant Examiner*—James Schaaf
*Attorney, Agent, or Firm*—Weintraub & Brady, P.C,

[57] ABSTRACT

An electrically-powered bumper car for use in an amusement game. The car is capable of precise movement due to a joystick control and processor connected thereto. This gives the car a movement controllable as to speed and direction, including the ability to stop and reverse directions without repositioning of the vehicle.

9 Claims, 3 Drawing Sheets

FIG 2
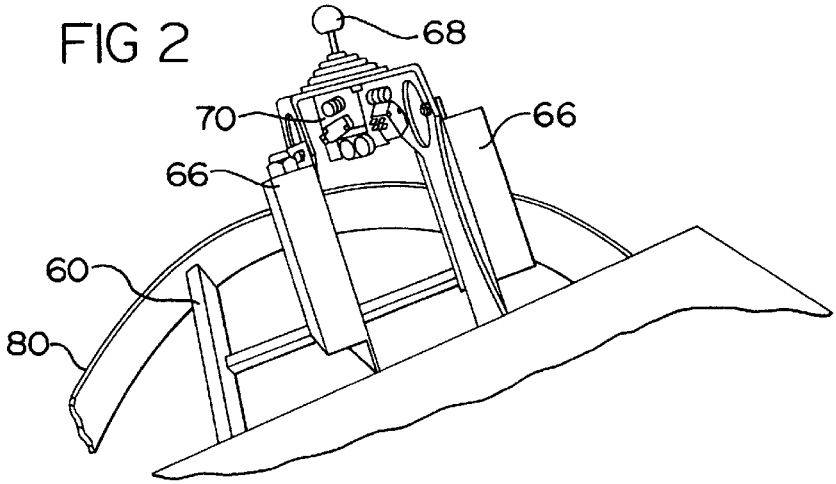
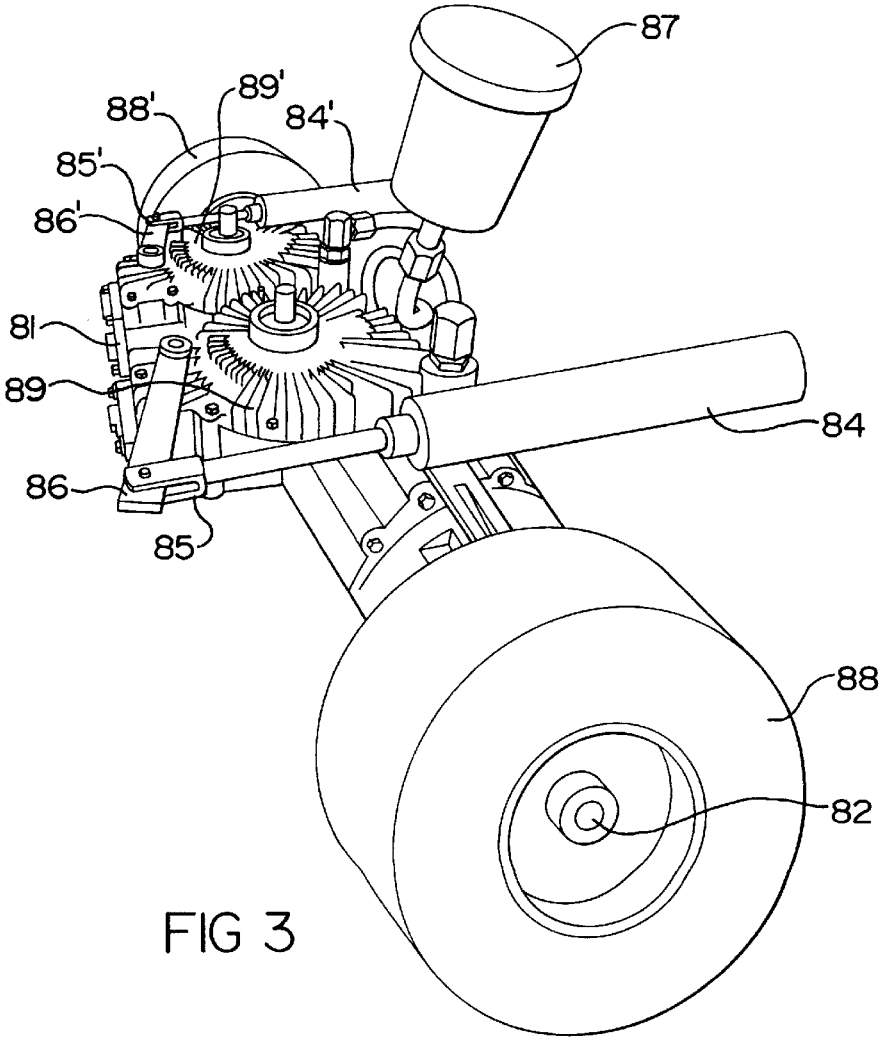
FIG 3

VEHICLE FOR AMUSEMENT GAME

CROSS-REFERENCE TO RELATED APPLICATIONS

This application is a continuation-in-part of U.S. patent application Ser. No. 08/206,117, now U.S. Pat. No. 5,577,736 entitled "ENTERTAINMENT GAME UTILIZING ELECTRICALLY POWERED CARS", filed Mar. 4, 1994, the disclosure of the above-identified application is incorporated herein by reference.

BACKGROUND OF THE INVENTION

1. Field of the Invention

The present invention concerns amusement games. More particularly, the present invention concerns a car to be used in amusement games.

2. Prior Art

As disclosed in the above-referred-to co-pending application, there is provided a motorized recreational vehicle commonly referred to as a "bumper car," which is commonly seen at carnivals and amusement parks. The invention defined in the co-pending application is an improved car that increases vehicle control during the playing of a game utilizing the car. The car thereof is predicated upon the use of a joystick to improve vehicle control. While the car thereof is efficacious, it is to be noted that the car requires an electrified floor for power, as well as mechanical actuators. The present invention as defined herein enables elimination of the electrified floor, if desired, as well as the mechanical actuators.

SUMMARY OF THE INVENTION

The present invention provides an amusement ride car, the car comprising:

(a) a chassis;

(b) a frame mounted upon the chassis;

(c) a means for powering the car;

(d) at least a pair of motors connected to the means for powering;

(e) a joystick mounted upon the frame to direct the car;

(f) a control unit mounted upon the frame to receive electrical impulses from the joystick;

(g) at least two wheels;

(h) at least one drive connected to the frame, the wheels being mounted within the at least one drive; and (i) means for positioning the wheels of the car in response to the control unit.

The present invention includes, in the preferred embodiment, the combined use of a joystick and a control unit to govern the direction and movement of the car. The car is propelled by the at least two motors one motor for each wheel. The car is further covered by a body made of fiberglass or a similarly durable substance.

The present invention will be more clearly understood with reference to the accompanying drawings, in which like reference numerals refer to like parts, in which:

BRIEF DESCRIPTION OF THE DRAWINGS

FIG. 2 is a rear view of the joystick control of the present invention;

FIG. 3 is a perspective view of the motor and related portions of the first embodiment of the present invention.

DETAILED DESCRIPTION OF THE PREFERRED EMBODIMENT

Figure 1:
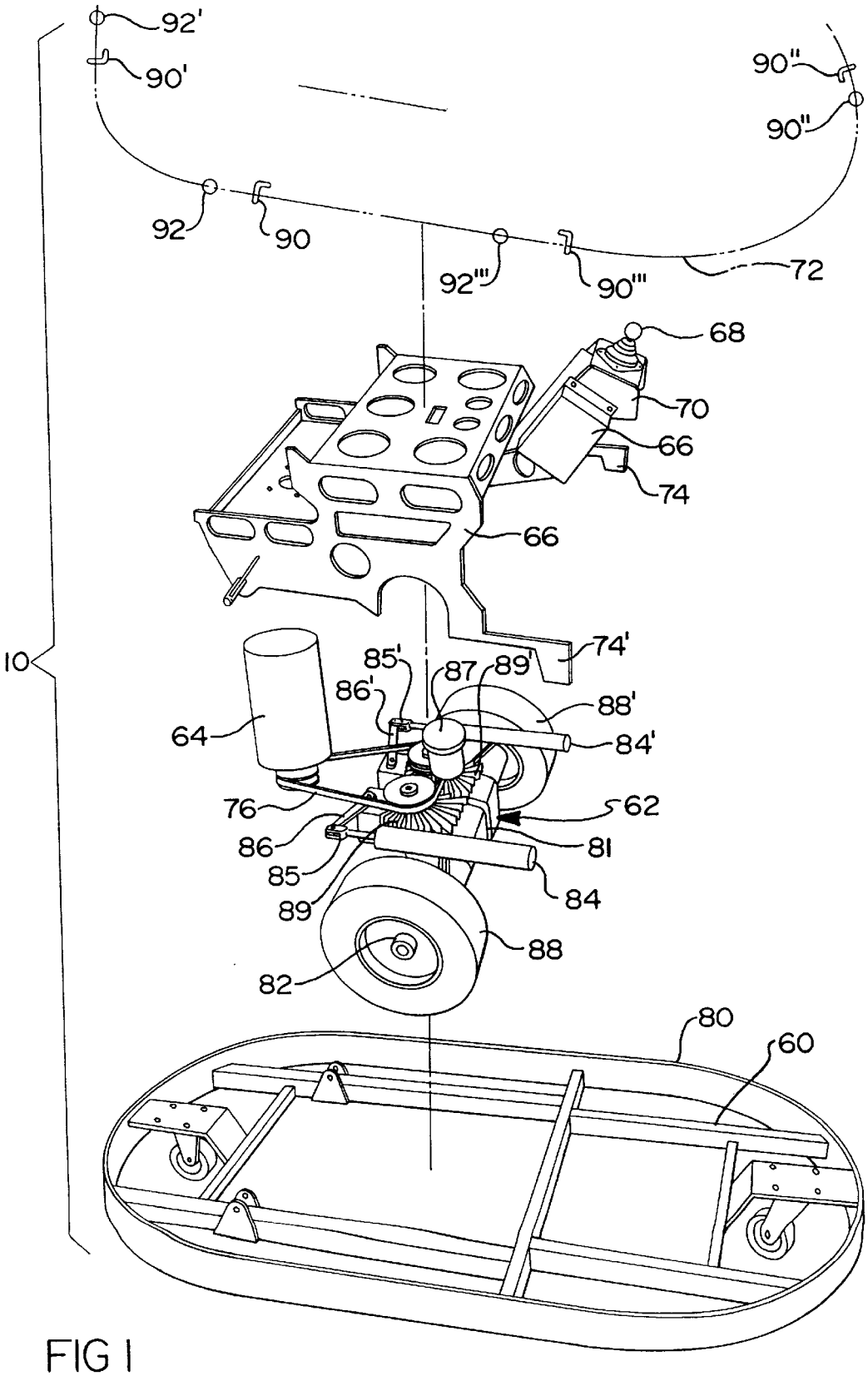
FIG. 1 is an exploded view of a preferred embodiment of the present invention.

Referring now to FIGS. 1–3, and as disclosed and shown in the co-pending application, there is provided an amusement ride car 10. The car 10, generally, comprises a chassis 60, a transaxle 62, a motor 64, a frame 66, a joystick 68, a control unit 70 and a body 72.

The car 10 of FIGS. 1–3 is adapted to be deployed on an electrified floor (not shown), which is known in the art. Such floors, generally, comprise a plurality of panels that alternate in polarity. That is, one panel has a positive polarity and the next panel has a negative polarity, followed by a positive polarity panel. An insulation strip is disposed between each pair of panels to prevent a complete circuit from being made between two adjacent panels. At no time are two panels of like polarity laid adjacent to each other. The floor is preferably made from stainless steel, which is a cleaner surface than the more common flooring, which utilizes carbonized steel. Stainless steel avoids the mess and odor associated with more common flooring.

To effect the absorption of current from the floor, the chassis 60 has a plurality of contacts 74, 74' formed thereon to make electrical contact with the flooring. The contacts 74, 74' are spaced out carefully, such that at least one contact touches a negative panel and at least one contact touches a positive panel. Ideally, there are four contacts disposed equally spaced in quadrants amid the chassis. Specifically, one is in the left front area of the chassis, one in the right front area, one in the left rear area, and one in the right rear area. This makes a complete circuit for the proper flow of current to be fed to the car 10.

The present invention envisions a voltage level in the floor that can be varied. The range of voltages can be from twenty-one volts to fifty-six volts, with the preferred voltage range being between thirty-two volts and forty-eight volts. The varying levels of voltage affect the maximum speed the car may achieve: The higher the voltage, the higher the maximum speed.

Each contact 74, 74' is connected to circuitry (not shown) comprising a pair of oppositely paired diodes. Each diode is connected to circuitry that directs the current to either a positive line or a negative line. The diodes act to prevent shorting in the power intake to the car 10.

The current is then, in part, fed to a power rectifier (not shown). The power rectifier accomplishes the conversion of the current from alternating current to direct current. The current is also directed, in part, to a transformer (not shown). The current leaving the transformer is set at a level of twelve volts, such that the joystick and control unit will not be overloaded.

The direct current is also fed to an electrical motor 64. The motor 64 produces rotational force, which is transmitted by a belt 76 to the transaxle 62. The electrical motor 64 may be selected from among those widely available on the market, one preferred example being that produced by the Ohio Electric Company of Barnardsville, N.C.

The transaxle 62 comprises a hydrostatic drive 81, a pair of independent axles 82, 82', a hydraulic fluid reservoir 87, and a pair of actuating cylinders or actuators 84, 84', each actuator 84, 84' having a clevis end 85, 85'. Alternately, the clevis ends 85, 85' may be replaced with rod ends, if desired. The hydrostatic drive 81 comprises two independent hydrostatic transmissions 89, 89', each having a hydraulic motor and a pump (not shown). Each pump is controlled by a tilting swashplate, which are joined to the extending members 86, 86' respectively. These members 86, 86' are fastened to the clevis ends 85, 85' of the actuators 84, 84'. By the motion of the actuators 84, 84', and therefore the extended members 86, 86', the transaxle 62 is altered in operation.

By the movement of the tilting swashplate, the pump inside the transmission is altered in its speed of operation. If the swashplate is tilted toward the cylinder block of the pump (not shown), the speed is increased. This causes the speed of the fixed swashplate within the transmission to increase, causing the hydraulic motor to run faster. This drives the axle and drive sprocket faster, causing that wheel to turn more quickly than its counterpart. By this action, turning in one direction or the other is achieved. If the swashplates of the two transmissions are inclined at the same angle, then the wheels will turn at the same speed. Thus, the car 10 will proceed in a straight path. Although many different models of hydrostatic drives are available, the preferred model is produced by Eaton Corporation of Cleveland, Ohio.

A wheel 88 is mounted to a hub (no shown) on each drive sprocket of the transaxle 62. The wheels 88 are the well-known tire with inner tubing, as are available from Power-master Corp. of Taiwan.

The frame 66 is mounted over the transaxle 62 and the motor 64, as seen in FIG. 1, so that these parts are shielded during the use of the car 10 and the rider of the car 10 is protected from them. Suitable padding and coverings (not shown) are mounted upon the frame 66, so that at least one rider may comfortably be seated thereupon. If the frame 66 is sufficiently large to accommodate more than one rider, the seating spaces (not shown) may be arranged in a plurality of configurations comprising side-by-side and fore-and-aft.

As seen in FIG. 1, a bumper 80 is deployed around the perimeter of the chassis 60. Typically, the bumper is defined by a tubing having a valve extending beyond the bumper 80. The tubing is inflated through the valve, such that the bumper may sustain the impacts encountered during driving. Further, the bumper can be formed by a tire and a tube disposed within the tire.

At least one laser gun 90 is mounted onto the car proximate the front end of the vehicle such that it can be grasped and shot by a driver or a passenger. The gun 90 is mounted on a pivot such that it may be freely rotatable in both horizontal and vertical planes. Additional laser guns 90' may be attached to the car disposed at any suitable position. The guns enable an occupant of the car to fire at another car (not shown). The laser beams, per se, are safe beams. Means 92 for detecting the impact of a laser beam defines a "target," and is also disposed on the vehicle or car 10 at any suitable position. Additional targets 92' may be attached to the car and are disposed at any suitable position. The means for detecting registers when a laser beam shot from a gun of another car hits the target. Suitable circuitry (not shown) disposed on the car is associated with a signalling device (not shown) to indicate the "hit." The signal may be audio, visual, or both.

As shown in the drawing, attached to the forward portion of the frame 66 are the joystick 68 and the control unit 70. The joystick 68 is similar to that commonly known in the arcade machine arts, and is used by the rider to indicate which direction the car 10 is to be traveling. The preferred embodiment of the joystick 68 is that distributed by OEM Corporation of Shelton, Conn. It is envisioned that foot pedals could be used in place of a joystick, in a less-preferred embodiment.

The joystick 68 is in electrical communication with the control unit 70. The control unit 70 comprises a microprocessor board having control algorithms loaded therein. The control unit 70 interprets the signals transmitted thereto by the joystick 68 to determine what direction the car 10 is to be directed. The signals from the joystick 68 are then translated into physical actions. This is accomplished by the control unit 70 passing electrical signals to the actuators 84, 84'. The control unit 70 indicates to the actuators 84, 84' what displacement is necessary for effecting the desired orientation of the car 10. The position of the joystick 68, also, will indicate whether motion is desired at all; thus, the actuators 84, 84' will allow or prevent translation of the power from the electrical motor 64 to the transaxle 62. Thus, the car 10 will move only when desired.

It is also possible for the car 10 to alter its orientation without movement. That is, the car 10 may pivot about its own transaxle 62 without moving either forwardly or rearwardly. This direction is indicated by positioning the joystick 68 either at a complete left position, to effect a counter-clockwise rotation, or at a complete right position, to effect a clockwise rotation.

The body 72 of the car 10 is formed of a lightweight yet durable plastic, fiberglass, or combination of these materials. Such composites are well known and widely available in the market. The body 72 serves to cover the internal components of the car while also adding a dimension of style to the car, depending upon the form into which it is made.

The movement of the car 10, thus, is precise, and nearly instantaneous to the movements of the joystick 68. Stopping is achieved by release of the joystick 68 to a neutral position, such braking being heretofore unknown in the bumper car art. Also, the speed achieved is quickly the maximum speed once engagement of the joystick 68 is made. This is due to the quick response time of the hydrostatic drive and the quick instruction time of the control unit 70. Thus, the car 10 moves smoothly and quickly in response to the instructions received. Also, braking is now achievable. Therefore, rapid change of direction or orientation otherwise is now possible, even by rotating on the axis of the car 10 itself. Such fluidity of motion and control has been unknown to the bumper car art and is a primary contribution to the art by the present invention.

Figure 4:
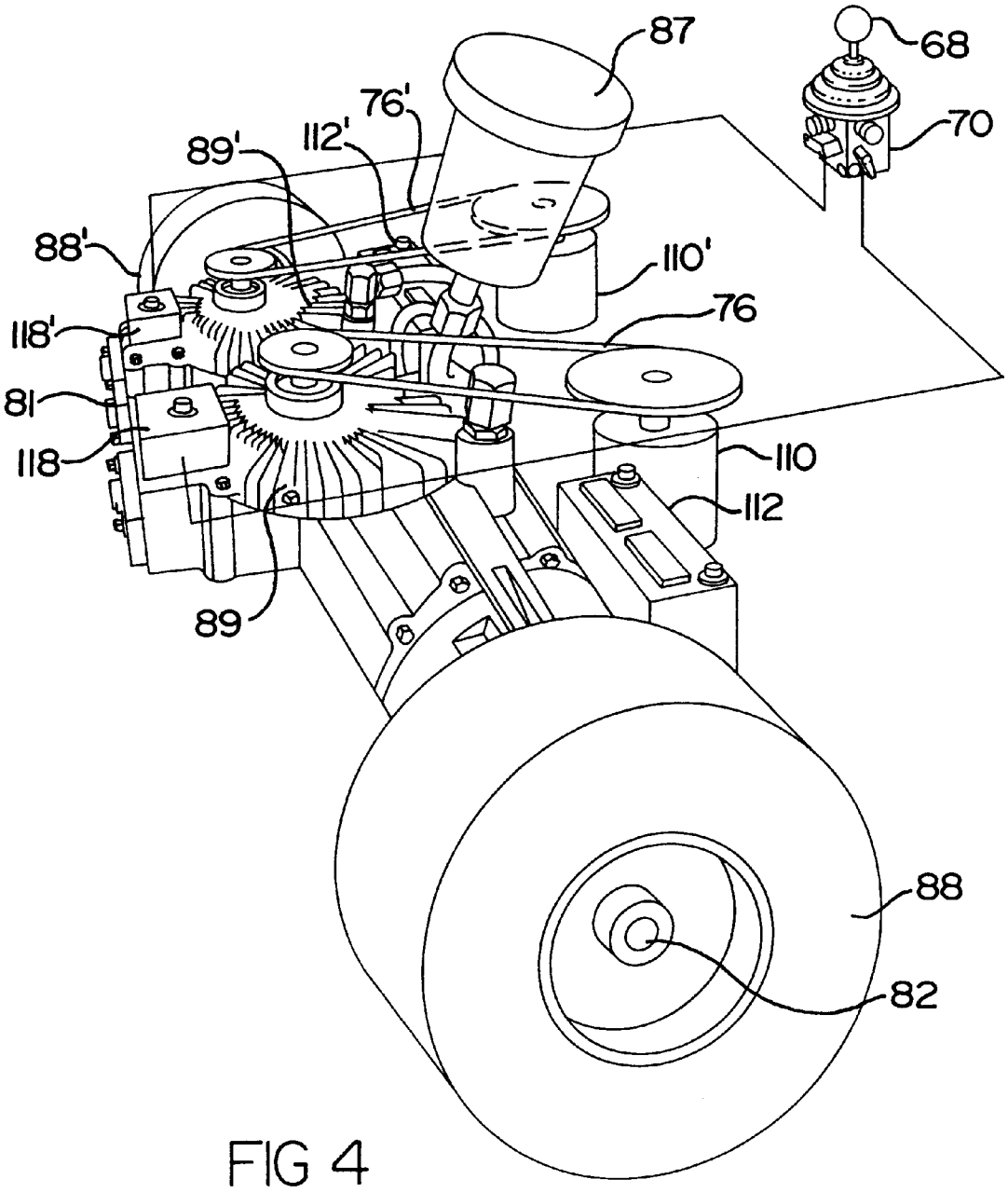
FIG. 4 is a perspective view of a second preferred embodiment of the present invention.

Turning now to FIG. 4, and in accordance herewith, an amusement car 100 includes a first motor 110 and a second motor 110', each motor being associated with a wheel 88 or 88' such that there is one motor for each wheel. The first and the second motors 110, 110' may be of any suitable construction, including a gear reduction motor, a belt/pulley reduction motor, or a hydraulic motor. The type of motor is selected to enable a direct drive therefrom to its associated wheel. Except for hydraulic motors, the actuators 84, 84', clevis ends 85, 85', extending members 86, 86', and hydrostatic drive 81 of the first embodiment are eliminated. If hydraulic motors are used, these elements are retained and implemented as shown in FIG. 3. When the motors 110, 110' are hydraulic, the car 10, also, comprises a first and a second electronically controlled valve body 118, 118', respectively, each valve body 118, 118' being in electrical communication with the control unit 70 and one of the hydraulic motors 110, 110'. The valve body controls flow of hydraulic fluid for driving the wheel in response to a signal received from the control unit 70, in the well-known manner. Where a non-hydraulic motor is used, the control unit 70 is directly connected to the motors 110, 110' to control the response thereof.

The car 10 further comprises at least one battery 112. The battery may either supplement or replace the power drawn from the floor in the first embodiment. The battery 112 is mounted to the vehicle 10 at any convenient point, and is electrically connected to the control unit 70. When power is drawn exclusively from the at least one battery 112 in the second embodiment, the elements used in the first embodiment to process power drawn from the floor are eliminated; these eliminated elements are the floor contacts 74, diodes (not shown), power rectifier (not shown), transformer (not shown), and transaxle 62. Where the battery is used as a supplementary source of power, it is placed in electrical communication with the electrical system used to power the vehicle when power is drawn from the floor. Suitable current levels are set to prevent overflow.

It is further envisioned that, in a further embodiment, a foot pedal control system can be arranged to replace the joystick 68. The pedals can be depressed to allow for turning, as well as for power. This would leave both hands free for activities other than maneuvering the car.

It is further contemplated that the vehicle may be outfitted with powered wheels at both the front and the back of the car in addition to the side wheels 88, 88'. The wheels would be deployed such that lateral movement can be achieved.

Having thus described the invention, what is claimed is:

1. A car for use in an amusement game, the car comprising:

(a) a chassis;

(b) at least two motors;

(c) at least two wheels, one motor driving an associated one wheel;

(d) a source of energy for operating the at least one motor;

(e) at least one dive to translate the power received from the motor to the associated wheel to drive and direct the car;

(f) a frame mounted upon the chassis;

(g) a joystick mounted upon the frame;

(h) a control unit in electrical communication with the joystick, the control unit being mounted upon the frame;

(i) a transaxle, the frame mounted above the transaxle, wherein the car may pivot about the transaxle without moving either forwardly of reawardly; and (j) a bumper deployed around the circumference of the chassis.

2. The car of claim 1 wherein the source of energy comprises at least one battery.

3. The car of claim 1, wherein the motors are gear reduction motors.

4. The car of claim 1, wherein the motors are belt/pulley reduction motors.

5. The car of claim 1, wherein the motors are hydraulic motors.

6. The car of claim 5 further comprising a pair of electronically controlled valve bodies, one for each motor and in fluid communication with the motor.

7. The car of claim 1 further comprising a body mounted upon the frame.

8. The car of claim 1, wherein the joystick is forwardly centrally mounted upon the frame.

9. A car for use in an amusement game, the car comprising:

(a) a chassis;

(b) at least two motors, (c) at least two wheels, one motor driving associated one wheel;

(d) a source of energy for operating the at least one motor, (e) at least one dive to translate the power received from the motor to the associated wheel to drive and direct the car;

(f) a frame mounted upon the chassis;

(g) a joystick mounted upon the frame;

(h) a control unit in electrical communication with the joystick, the control unit being mounted upon the frame; and (i) at least one laser beam projection device mounted to the car; and (j) at least one laser target device mounted to the car.

* * * * *